United States Patent [19]

Grant

[11] Patent Number: 4,939,804

[45] Date of Patent: Jul. 10, 1990

[54] BED VENTILATING APPARATUS AND METHOD

[76] Inventor: William N. Grant, 8301 Forrest Oak Dr., Fort Worth, Tex. 76180

[21] Appl. No.: 384,561

[22] Filed: Jul. 24, 1989

[51] Int. Cl.[5] ..... A47C 21/04

[52] U.S. Cl. ..... 5/468; 5/469; 5/508

[58] Field of Search ..... 5/469, 468, 505, 506, 5/508, 421, 423, 284

[56] References Cited

U.S. PATENT DOCUMENTS

| | | | |
|---|---|---|---|
| 1,142,876 | 6/1915 | Daris | 5/284 |
| 2,097,751 | 11/1937 | Baltich . | |
| 2,461,432 | 2/1949 | Mitchell . | |
| 2,585,517 | 2/1952 | Tolen . | |
| 2,695,413 | 11/1954 | Ter Maat . | |
| 3,101,488 | 8/1963 | Peebles . | |
| 3,230,556 | 1/1966 | Shippee . | |
| 3,266,064 | 8/1966 | Figman . | |
| 3,317,932 | 5/1967 | Gibbons | 5/505 |
| 3,444,922 | 5/1969 | Dingman . | |
| 3,713,182 | 1/1973 | McNeal . | |
| 4,305,168 | 12/1981 | Holter et al. . | |
| 4,602,486 | 7/1986 | Weinstein | 5/421 |

FOREIGN PATENT DOCUMENTS

| | | | |
|---|---|---|---|
| 340131 | 8/1921 | Fed. Rep. of Germany | 5/284 |
| 3203674 | 8/1983 | Fed. Rep. of Germany | 5/508 |
| 1386249 | 3/1972 | United Kingdom | 5/421 |

*Primary Examiner*—Gary L. Smith
*Assistant Examiner*—F. Saether
*Attorney, Agent, or Firm*—Charles D. Gunter, Jr.

[57] ABSTRACT

An apparatus for ventilating a bed in a room includes an elongate housing having an upper and lower extent. The upper extent is provided with an air inlet opening for receiving stale air and an outlet duct is provided for exhausting filtered air into the room. A mounting flange extends outwardly from the housing and is received between the bed mattress and boxspring for supporting the housing at the foot of the bed. At least one recirculating duct recirculates filtered air from the elongate housing under the bedcover back to the bed.

10 Claims, 2 Drawing Sheets

BED VENTILATING APPARATUS AND METHOD

BACKGROUND OF THE INVENTION

1. Field of the Invention

The present invention relates to air purifying and ventilating means for beds.

2. Description of the Prior Art

Nursing homes, hospitals or private homes where invalid patients are confined often have problems in connection with odors emanating from the patients body, open wounds and the like. Seriously ill patients often cannot leave their beds and the whole life cycle of the patients takes place in the bed. It is often difficult to avoid annoying odors which develop. Annoying odors can also develop from wounds or cuts or during the change of surgical dressing. These odors pose a hardship not only to the patient but to those caring for the patient and other occupants of adjacent areas.

Many hospitals and retirement homes have adopted "egg crate" foam mattress pads in an attempt to increase the air circulation and comfort of the patients. Although foam pads increase patient comfort, they do not allow a continuous supply of fresh air around the patients body.

The present invention has as its object to provide a simple and economical means for ventilating a bed beneath the bedcover to purify foul air so as to render the same substantially odor-free when the air is discharged from the bed.

Another object of the invention is to provide a portable bed ventilating device which is easily concealed beneath a conventional bedcover and which adds less than one inch to the length of the bed.

Another object of the invention is to provide a bed ventilating device which produces an air movement which is barely detectable by the user and which produces negligible body heat loss.

Additional objects, features and advantages will be apparent in the written description which follows.

SUMMARY OF THE INVENTION

The bed ventilating apparatus of the invention is intended for use with a bed having a head, a foot and a mattress positioned above a box spring. The apparatus includes an elongate housing having an upper extent and a lower extent and having a longitudinal axis which is positionable parallel to the foot of the bed. The upper extent of the elongate housing is provided with at least one air inlet opening for receiving stale air. The elongate housing also has an outlet duct for exhausting air into the room. At least one mounting flange extends outwardly from the elongate housing generally perpendicular to the longitudinal axis thereof. The mounting flange is adapted to be received between the mattress and the boxspring for supporting the elongate housing on the bed. Filtration means are located between the air inlet opening to the elongate housing and the outlet duct for filtering the stale air entering the housing. At least one recirculating duct is associated with the elongate housing for recirculating filtered air from the elongate housing back to the bed. Fan means are provided for drawing air through the air inlet opening, for exhausting filtered air out the outlet duct and for recirculating a portion of the filtered air through the recirculation duct.

DETAILED DESCRIPTION OF THE INVENTION

Figure 1:
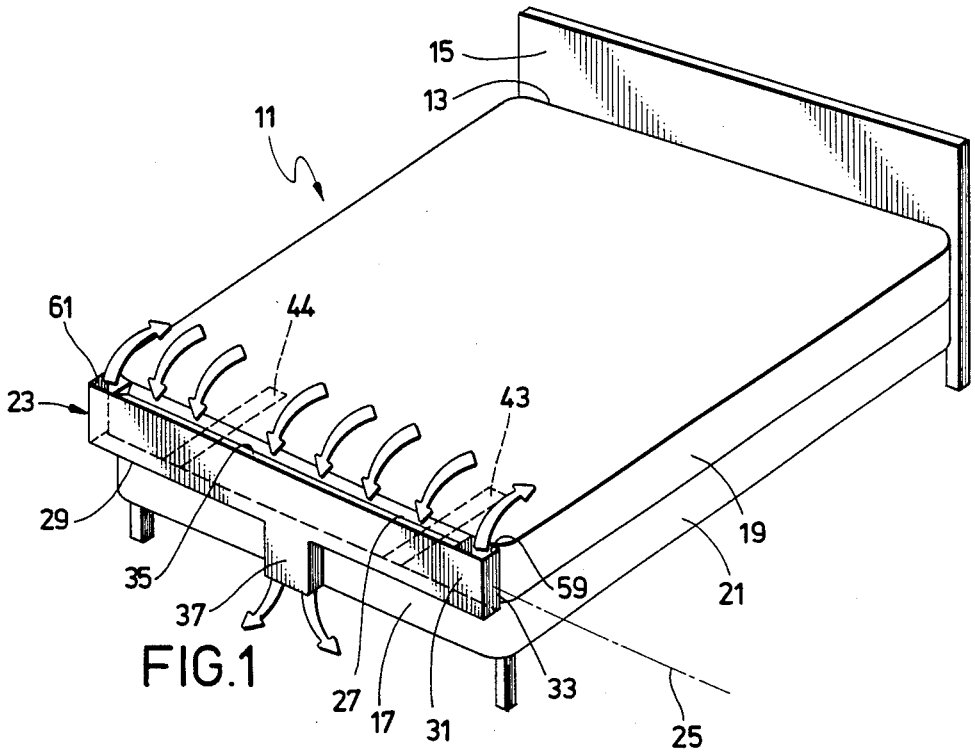
FIG. 1 is a perspective view of a hospital bed having the ventilating apparatus of the invention mounted at the foot of the bed.

FIG. 1 shows a hospital bed 11 equipped with the ventilating apparatus of the invention. The bed 11 includes a head 13 with a headboard 15, a foot 17 and a mattress 19 positioned above a boxspring 21.

The ventilating apparatus of the invention includes an elongate housing 23 having an upper extent and a lower extent and a longitudinal axis 25 which is positionable parallel to the foot 17 of the bed 11. The elongate housing 23 is preferably configured as a generally rectangular member having an upper wall 27 which extends substantially the length of the bed, a lower wall 29 and opposing sidewalls 31, 33. The upper wall 27 includes at least one air inlet opening 35 for receiving stale air. The elongate housing 23 also includes an exhaust outlet duct 37 which is located in the bottom wall 29 of the housing in the approximate mid-region thereof.

Figure 3:
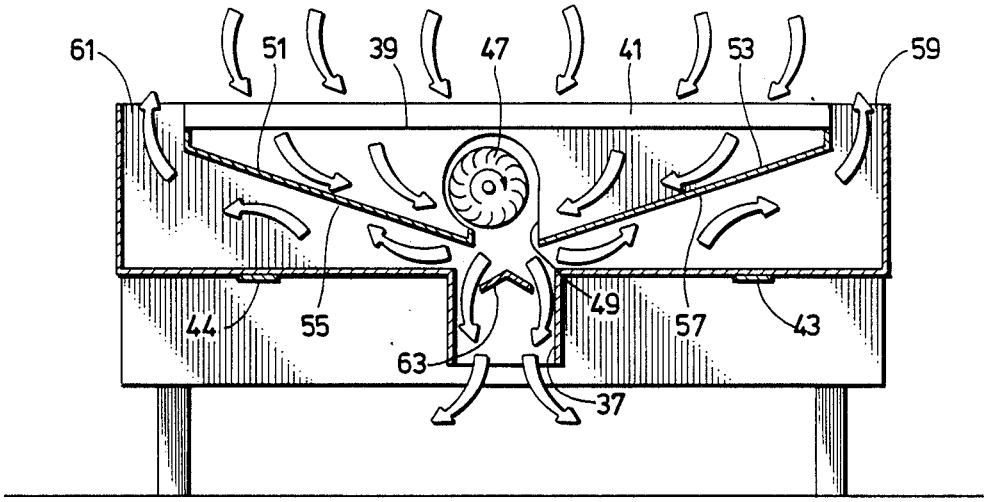
FIG. 3 is an end view of the bed of FIG. 1 showing a cross-sectional view of the ventilating apparatus.

As shown in FIGS. 3, an internal recess 39 beneath the upper wall 27 is sized to receive a filtration material, such as charcoal/silica filter 41, whereby stale air entering the air inlet opening 35 passes through the filtration material 41 as it enters the elongate housing 23. The filtration material 41 can be exposed through a single air inlet opening 35 or can be enclosed by a cover (not shown) which covers the inlet opening 35 and is provided with a plurality of apertures.

At least one mounting flange is provided for mounting the elongate housing 23 on the bed 11.

Figure 4:
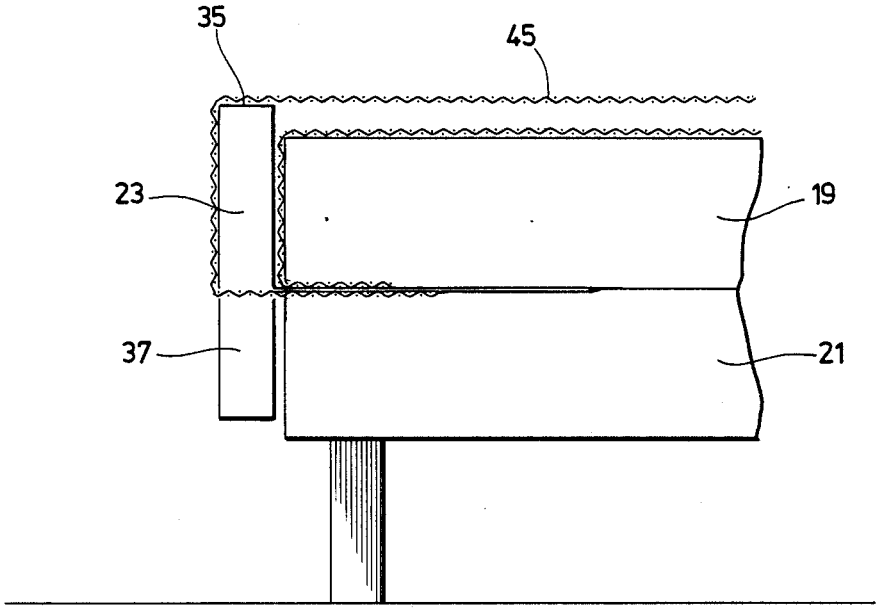
FIG. 4 is a fragmentary, side view of the bed and ventilating apparatus of FIG. 3.

Preferably, a pair of mounting flanges 43, 44 extend outwardly from the elongate housing 23 generally perpendicular to the longitudinal axis 25. The mounting flanges 43, 44 are adapted to be received between the mattress 19 and boxspring 21 for supporting the elongate housing at the foot of the bed. As best seen in FIG. 4, the mounting flanges are located a predetermined distance below the housing upper wall 35 whereby the upper wall extends slightly above the level of the mattress 19 when the elongate housing is positioned at the foot of the bed. Preferably, the housing upper wall 35 extends about $\frac{1}{8}$ to $\frac{1}{4}$ inch above the level of the mattress 19.

Figure 2:
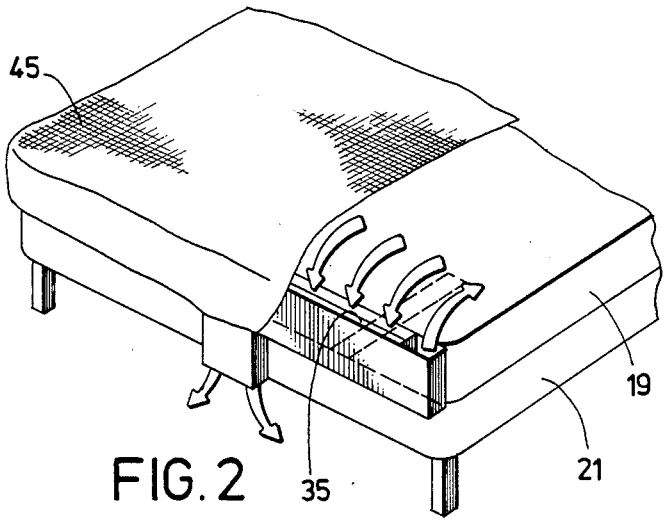
FIG. 2 is a fragmentary perspective view of the bed of FIG. 1 showing the placement of the bedcover with respect to the ventilating apparatus of the invention.

The bed 11 is also provided with a bedcover, such as sheet 45 (FIG. 2). The sheet can be tucked at the bed foot between the mattress 19 and boxspring 21, thereby covering the air inlet opening 35.

As shown in FIG. 3, an electric fan 47 is provided within the elongate housing 23 for drawing air through the inlet opening 35 and for exhausting air out the exhaust duct 37. Fan 47 can be, for instance, a small "C" frame AC 110 volt fan motor.

As shown in FIGS. 3, the fan 47 is mounted on the opposing sidewall 33 of the elongate housing 23 beneath the filtration material 41 in a primary air passageway 49 which communicates filtered air to the exhaust outlet duct 37. A pair of internal baffles 51, 53 slope downwardly in inclined fashion from the upper wall and converge at the primary air passageway 49 for directing incoming air toward the exhaust outlet duct 37.

A pair of diverging alternate air passageways 55, 57 communicate a portion of the filtered air to a pair of oppositely arranged recirculation ducts 59, 61. The alternate air passageways 55, 57 extend generally perpendicular to the direction of air flow in the primary air passageway 49. A deflecting vane 63 forms a V-shaped obstruction in the primary air passageway 49 for deflecting a portion of the filtered air to the alternate passageways 55, 57. In this way, a portion of the filtered air can be recirculated through the ducts 59, 61 back beneath the bedcover 55.

An invention has been provided with several advantages. The ventilating apparatus of the invention is simple in design and economical to manufacture. The device can be unobtrusively mounted at the foot of a bed without interfering with the normal make-up of the bed. Because the apparatus is mounted at the bed foot, valuable bed space is conserved. In addition to filtering stale air and exhausting fresh air back into the room, a portion of the fresh air is recirculated beneath the bedcover for the comfort of the patient. The filtration means can be easily accessed for cleaning or replacement.

While the invention has been shown in only one of its forms, it is not thus limited but is susceptible to various changes and modifications without departing from the spirit thereof.

I claim:

1. An apparatus for ventilating a bed in a room, the bed having a head, a foot, and a mattress positioned above a box spring, the apparatus comprising:

an elongate housing having an upper extent and a lower extent and having a longitudinal axis which is positionable parallel to the foot of the bed, the upper extent of the elongate housing being provided with at least one air inlet opening for receiving stale air, the elongate housing also having an outlet duct for exhausting air into the room;

at least one mounting flange extending outwardly from the elongate housing generally perpendicular to the longitudinal axis thereof, the mounting flange being adapted to be received between the mattress and box spring for supporting the elongate housing on the bed;

filtration means located between the air inlet opening to the elongate housing and the outlet duct for filtering the stale air entering the housing;

at least one recirculating duct associated with the elongate housing for recirculating filtered air from the elongate housing back to the bed; and fan means for drawing air through the air inlet opening, for exhausting filtered air out the outlet duct and for recirculating a portion of the filtered air through the recirculation duct.

2. The apparatus of claim 1, wherein the elongate housing has an upper wall which extends substantially the length of the bed, a lower wall and opposing sidewalls, the air inlet opening being located in the upper wall, and wherein the elongate housing is provided with an internal recess beneath the upper wall, the internal recess being sized to receive a filtration material, whereby stale air entering the air inlet opening passes through the filtration material as it enters the elongate housing.

3. The apparatus of claim 2, wherein a fan is located beneath the filtration material in the elongate housing and wherein the housing is provided with a primary air passageway which communicates filtered air to the exhaust outlet duct and at least one alternate passageway which communicates a portion of the filtered air to the recirculation duct.

4. The apparatus of claim 3, wherein the exhaust outlet is located in the bottom wall of the elongate housing in the approximate mid-region thereof, the primary air passageway extending vertically downward from the air inlet opening to the exhaust duct.

5. The apparatus of claim 4, wherein the elongate housing is provided with a pair of alternate passageways extending generally perpendicular to the direction of air flow in the primary air passageway, each of the alternate passageways being in fluid communication with an associated recirculation duct.

6. The apparatus of claim 5, further comprising:

deflecting means located in the primary air passageway for deflecting a portion of the filtered air to the alternate passageways.

7. An apparatus for ventilating a bed in a room, the bed having a head, a foot, and a mattress positioned above a box spring, the bed being covered with a bedcover, the apparatus comprising:

an elongate housing having an upper wall, a lower wall and having a longitudinal axis which is positionable parallel to the foot of the bed, the upper wall of the elongate housing being provided with at least one air inlet opening for receiving stale air, the elongate housing also having an outlet duct for exhausting air into the room;

at least one mounting flange extending outwardly from the elongate housing generally perpendicular to the longitudinal axis thereof, the mounting flange being adapted to be received between the mattress and box spring for supporting the elongate housing on the bed with the bedcover at least partly covering the housing;

filtration means located between the air inlet opening to the elongate housing and the outlet duct for filtering the stale air drawn from beneath the bedcover and entering the housing;

at least one recirculating duct associated with the elongate housing for recirculating filtered air from the elongate housing back beneath the bedcover-;and fan means for drawing air through the air inlet opening, for exhausting filtered air out the outlet duct and for recirculating a portion of the filtered air through the recirculation duct.

8. The apparatus of claim 7, wherein the mounting flange is located a predetermined distance below the housing upper wall, whereby the upper wall extends slightly above the level of the mattress when the elongate housing is positioned at the foot of the bed.

9. A method for ventilating a bed in a room, the bed having a head, a foot, a mattress positioned above a box spring, and having a bedcover, the method comprising the steps of:

positioning an elongate housing having an upper extent and a lower extent at the foot of the bed, the upper extent of the elongate housing being provided with at least one air inlet opening for receiving stale air, the elongate housing also having an outlet duct for exhausting air into the room;

mounting the elongate housing on the bed with the air inlet opening covered by the bedcover, whereby stale air can be drawn from beneath the bedcover into the air inlet opening;

passing the entering air through filtration means located between the air inlet opening to the elongate housing and the outlet duct;

exhausting a portion of the filtered air out the outlet duct back into the room; and recirculating at least a portion of the filtered air in the elongate housing through a recirculation duct and back under the bedcover.

10. The method of claim 9, wherein the elongated housing is mounted on a mounting flange which extends outwardly from the elongate housing generally perpendicular to the longitudinal axis thereof, the mounting flange being adapted to be received between the mattress and box spring for supporting the elongate housing on the bed.

* * * * *